US010749298B2

(12) United States Patent
Cyzen

(10) Patent No.: US 10,749,298 B2
(45) Date of Patent: Aug. 18, 2020

(54) PLUG RETENTION SYSTEM

(71) Applicant: Keith Cyzen, Glen Ellyn, IL (US)

(72) Inventor: Keith Cyzen, Glen Ellyn, IL (US)

( * ) Notice: Subject to any disclaimer, the term of this patent is extended or adjusted under 35 U.S.C. 154(b) by 0 days.

(21) Appl. No.: 16/354,825

(22) Filed: Mar. 15, 2019

(65) Prior Publication Data

US 2019/0214770 A1 Jul. 11, 2019

Related U.S. Application Data

(62) Division of application No. 15/842,437, filed on Dec. 14, 2017, now Pat. No. 10,276,979.

(60) Provisional application No. 62/589,930, filed on Nov. 22, 2017, provisional application No. 62/579,314, filed on Oct. 31, 2017, provisional application No. 62/544,248, filed on Aug. 11, 2017.

(51) Int. Cl.

| | |
|---|---|
| ***H01R 13/62*** | (2006.01) |
| ***H01R 13/639*** | (2006.01) |
| ***H01R 25/00*** | (2006.01) |
| ***H01R 31/06*** | (2006.01) |

(52) U.S. Cl.

CPC ..... *H01R 13/6395* (2013.01); *H01R 13/6392* (2013.01); *H01R 25/003* (2013.01); *H01R 31/06* (2013.01); *H01R 13/6397* (2013.01)

(58) Field of Classification Search

CPC ..... H01R 13/6392; H01R 13/62933; H01R 25/006; H01R 23/025; H01R 31/02; H02G 3/14

USPC .... 439/367–373, 535, 536, 652; 174/66, 67; 220/242

See application file for complete search history.

(56) References Cited

U.S. PATENT DOCUMENTS

| | | | |
|---|---|---|---|
| 2,438,143 | A | 3/1948 | Brown |
| D162,509 | S | 3/1951 | Austin, Jr. |
| 2,673,969 | A | 3/1954 | Pfister |
| 2,722,665 | A | 11/1955 | Sauder |
| 2,770,697 | A | 11/1956 | Kellett |
| 3,013,105 | A | 12/1961 | Craig |
| 3,113,996 | A | 12/1963 | Sanford |
| 3,159,446 | A | 12/1964 | Protzmann |
| 3,257,497 | A | 6/1966 | Chase |

(Continued)

FOREIGN PATENT DOCUMENTS

CN 203589299 U 5/2014

OTHER PUBLICATIONS https://www.amazon.com/Lock-Plug-Electrical-Extension-Appliances/dp/B06WW61RRC, publicly available at least as early as Dec. 17, 2017.

(Continued)

*Primary Examiner* — Thanh Tam T Le

(74) *Attorney, Agent, or Firm* — Marshall, Gerstein & Borun LLP

(57) ABSTRACT

Retention components are provided that are configured to retain a first end of an electrical cord in a plugged configuration with an electrical outlet. The retention components have an interior sized to receive the first end therein and include an wire opening having at least one dimension that is smaller than the corresponding dimension of the first end so that the first end cannot pass therethrough. In one form, a wall plate is provided having retention portion configured to retain a first end of an electrical cord, such that with the wall plate secured to a wall or other substrate, the first end of the electrical cord is retained between the wall and the wall plate.

17 Claims, 9 Drawing Sheets

(56) References Cited

U.S. PATENT DOCUMENTS

| | | | |
|---|---|---|---|
| 3,689,868 | A | 9/1972 | Snyder |
| 3,775,729 | A | 11/1973 | Casper |
| 4,083,618 | A | 4/1978 | Busch, Jr. |
| D261,135 | S | 10/1981 | Horne |
| 4,293,173 | A | 10/1981 | Tricca |
| 4,457,571 | A | 7/1984 | Lavine et al. |
| D275,175 | S | 8/1984 | Rolli, Jr. |
| D283,221 | S | 4/1986 | West |
| 4,617,613 | A | 10/1986 | Rice |
| 4,895,527 | A | 1/1990 | Brown et al. |
| 4,895,999 | A | 1/1990 | Calderon |
| 4,921,444 | A | 5/1990 | Cama |
| D308,626 | S | 6/1990 | Villarreal |
| D309,093 | S | 7/1990 | Reinholt |
| 4,969,833 | A | 11/1990 | Lindow et al. |
| 4,973,801 | A | 11/1990 | Frick et al. |
| 4,993,963 | A | 2/1991 | Pedigo |
| 5,011,427 | A | 4/1991 | Martin |
| D317,859 | S | 7/1991 | Kobayashi |
| D318,460 | S | 7/1991 | Heath et al. |
| 5,174,773 | A | 12/1992 | Jones |
| D346,362 | S | 4/1994 | Bouley |
| D359,271 | S | 6/1995 | Reinholt |
| D372,224 | S | 7/1996 | Larned et al. |
| 5,575,677 | A | 11/1996 | Buckner et al. |
| 5,589,665 | A | 12/1996 | Scamacca |
| 5,655,924 | A | 8/1997 | Cross et al. |
| D415,113 | S | 10/1999 | Driver, III |
| 5,989,052 | A | 11/1999 | Fields et al. |
| 6,699,060 | B1 | 3/2004 | Scott |
| D508,025 | S | 8/2005 | Dirks |
| D509,193 | S | 9/2005 | Piedmont |
| 7,014,493 | B1 | 3/2006 | Battard |
| 7,041,905 | B1 | 5/2006 | Stewart |
| 7,056,145 | B2 | 6/2006 | Campbell, III et al. |
| D549,175 | S | 8/2007 | Slasinski |
| 7,255,588 | B2 | 8/2007 | Wilder |
| D559,782 | S | 1/2008 | Slasinski |
| 7,371,105 | B1 | 5/2008 | Allende |
| 7,384,304 | B1 | 6/2008 | Fawcett |
| 7,528,323 | B2 | 5/2009 | Wu et al. |
| 7,638,710 | B1 | 12/2009 | Vance |
| 7,850,478 | B2 | 12/2010 | Lin et al. |
| 8,021,174 | B1 | 9/2011 | Schutte |
| 8,222,522 | B1 | 7/2012 | Easthouse |
| 8,337,236 | B2 | 12/2012 | Shu |
| 8,864,517 | B2 | 10/2014 | Cohen |
| 9,048,570 | B2 | 6/2015 | Goel |
| 9,065,263 | B2 | 6/2015 | Porcano |
| 9,083,180 | B2 | 7/2015 | Dodal et al. |
| 9,147,973 | B1 | 9/2015 | Madison |
| 9,337,676 | B2 | 5/2016 | Benigno |
| 9,350,151 | B2 | 5/2016 | Michaelis, IV |
| D784,791 | S | 4/2017 | Aragaw |
| D788,045 | S | 5/2017 | Zeng |
| 9,653,898 | B1 | 5/2017 | Deaton et al. |
| D793,846 | S | 8/2017 | Armstrong, Jr. et al. |
| 9,825,414 | B2 * | 11/2017 | Armstrong ..... H01R 31/06 |
| 9,991,627 | B1 | 6/2018 | Hemme |
| D823,263 | S | 7/2018 | Cyzen |
| 10,148,033 | B2 | 12/2018 | Mortun |
| 10,276,979 | B2 | 4/2019 | Cyzen |
| D860,141 | S | 9/2019 | Cyzen |
| 10,439,327 | B1 | 10/2019 | Cyzen |
| D871,351 | S | 12/2019 | Lee et al. |
| 2011/0070756 | A1 | 3/2011 | Peckham |
| 2015/0147908 | A1 | 5/2015 | Jauch |
| 2017/0214201 | A1 | 7/2017 | Armstrong et al. |
| 2020/0021060 | A1 | 1/2020 | Cyzen |

OTHER PUBLICATIONS https://www.amazon.com/LectraLock-Safety-Electrical-Outlet-Duplex/dp/B009UX0NBO/ref=zg_bs_166867011_6?_encoding=UTF8&refRID=EMGGM%E2%80%A6, publicly available at least as early as Dec. 17, 2017.

https://www.amazon.com/gp/offer-listing/B073V3LR2R/ref=dp_olp_new_mbc?ie-UTF8&condition-new, publicly available at least as early as Dec. 17, 2017.

https://www.amazon.com/Secure-Connect-Electrical-Safety-Product/dp/B0083V4NG0/ref=pd_sbs_107_5?_encoding=UTF8&pd_rd_i=B0083V4NG0&p%E2%80%A6, publicly available at least as early as Dec. 17, 2017.

https://www.kickstarter.com/projects/1881196998/myplug-the-first-theft-proof-charging-cable-ever-m?ref=nav_search, publicly available at least as early as Dec. 17, 2017.

http://ideas.northwestern.edu/projects/charger+.html, publicly available at least as early as Dec. 17, 2017.

http://www.ichargerlock.com/, publicly available at least as early as Dec. 17, 2017.

ttps://www.kickstarter.com/projects/1881196998/myplug-the-first-theft-proof-charging-cable-ever-m?ref=nav_search, publicly available at least as early as Dec. 17, 2017.

International Search Report and Written Opinion of the International Searching Authority for International Application PCT/US2018/043358, dated Oct. 9, 2018.

International Application No. PCT/US2019/038251, International Search Report and Written Opinion, dated Sep. 17, 2019.

Chinese Patent Application No. 201810013949.3, First Office Action, dated Feb. 3, 2020.

* cited by examiner

PLUG RETENTION SYSTEM

CROSS-REFERENCE TO RELATED APPLICATIONS

This application is a divisional of U.S. Ser. No. 15/842,437, filed Dec. 14, 2017, which claims the benefit of U.S. Provisional Application No. 62/544,248, filed Aug. 11, 2017, U.S. Provisional Application No. 62/579,314, filed Oct. 31, 2017, and U.S. Provisional Application No. 62/589,930, filed Nov. 22, 2017, which are all incorporated by reference herein in their entirety.

FIELD OF THE DISCLOSURE

The present disclosure generally relates to plugs for electronic devices and, more particularly, to retention components for electrical outlets.

BACKGROUND

Cords to recharge and connect mobile devices have taken on many forms with advances in technology. In one current form, a cord includes a connector at a first end thereof that is configured to connect to the mobile device and another connector at a second end to connect to a power source or second electronic device. One common connector for the second end is a Universal Serial Bus (USB) connector that allows the mobile device to be connected to a computing device or power source having a corresponding port. The USB connector can also be utilized in conjunction with an adapter to plug the mobile device into a wall outlet to recharge the mobile device. Unfortunately, with the increase in connections, the chance that one of the connections is inadvertently separated increases.

SUMMARY

In some embodiments, a wall plate for securing a first end of an electrical cord to a power supply is described herein that includes: a base portion and a retention portion extending outwardly from the base portion. The retention portion has an interior sized to receive the first end of the electrical cord therein. The retention portion includes a back and a front opening to the interior thereof. The back opening is configured to align with the power supply and the front opening is sized to have at least one dimension smaller than the first end of the electrical cord such that the first end cannot pass therethrough.

By one approach, the base portion can be configured to be removably secured to a wall outlet so that a socket is aligned with the back opening of the retention portion. By a further approach, the base portion can also include a socket opening configured to align with a second socket of the wall outlet.

By another approach, the first end of the electrical cord can include an adapter and a first connector, where the adapter is configured to electrically couple the first connector to the power supply. In this approach, the retention portion can include a main portion sized to receive the adapter therein and an extension portion extending away from the main portion sized to receive the first connector therein. By further approaches, the extension portion can include a narrowing portion defining the front opening; the retention portion can include a shoulder extending between the main portion and the extension portion, where the shoulder is configured to retain the adapter in a connected configuration with the power supply; a cross-section of the main portion can have dimensions slightly larger than corresponding dimensions of the adapter; and a cross-section of the extension portion can have dimensions slightly larger than corresponding dimensions of the first connector.

By yet another approach, the interior of the retention portion can have a depth equal to or slightly larger than a depth of the first end of the electrical cord.

In some embodiments, a retention system for securing a first end of an electrical cord to a power supply in combination with a wall plate is described herein. The retention system includes a retention member having a body. A retention portion of the body has an interior sized to receive the first end of the electrical cord therein. The retention portion includes a rear edge that defines a back opening configured to align with the power supply and a front opening that is sized to have at least one dimension smaller than the first end of the electrical cord such that the first end of the electrical cord cannot pass therethrough. A flange portion of the body extends outwardly from the rear edge of the retention portion. The flange portion is configured to be trapped behind the wall plate with the wall plate secured around the power supply and the retention portion is configured to extend through a socket opening of the wall plate, such that the retention member retains the first end of the electrical cord to the power supply.

By one approach, the first end of the electrical cord can include an adapter and a first connector, where the adapter is configured to electrically couple the first connector to the power supply. In this approach, the retention portion can include a main portion sized to receive the adapter therein and an extension portion extending away from the main portion sized to receive the first connector therein. By a further approach, the extension portion can include a narrowing portion defining the front opening. By further approaches, the retention portion can include a shoulder extending between the main portion and the extension portion, where the shoulder is configured to retain the adapter in a connected configuration with the power supply.

By another approach, a cross-section of the main portion can have a shape complementary to the socket opening of the wall plate.

By several approaches, the retention system can further include one or more user selectable spacers, where each user selectable spacer is separately insertable into the interior of the retention portion for accommodating different electrical cords.

In some embodiments, a method of manufacturing the retention member of any of the above embodiments is described herein.

In some embodiments, a retention member is described herein that is configured to secure to a housing around an electrical outlet to thereby retain a first end of an electrical cord in a plugged configuration with the electrical outlet. The retention member includes a body having a sidewall and an end wall that define an interior. The sidewall defines a plug opening at a first end of the body and the end wall has a wire opening extending therethrough at a second, opposite end of the body. Further, the plug opening is sized to receive the first end of the electrical cord therethrough and the wire opening has at least one dimension that is smaller than a corresponding dimension of the first end, such that the first end cannot pass therethrough.

By one approach, the body can have a stepped configuration with a main portion configured to receive an adapter therein and an extension portion configured to receive a connector of the electrical cord therein. Further, the body can include a shoulder extending between the main portion and the extension portion that is configured to retain the adapter in a connected configuration with the electrical outlet.

By another approach, the body can include a tab portion that projects outwardly from the first end thereof, where the tab portion is configured to receive a fastener therethrough to couple the retention member to the housing around the electrical outlet.

In some embodiments, the retention member of the above forms can be in combination with the housing, where the housing includes a channel extending adjacent to the electrical outlet and the body includes a portion of the first end thereof configured to be inserted into the channel to secure the body to the housing.

BRIEF DESCRIPTION OF THE DRAWINGS

The above needs are at least partially met through provision of the plug retention embodiments described in the following detailed description, particularly when studied in conjunction with the drawings, wherein.

DETAILED DESCRIPTION

Retention components are described herein configured to couple to structure adjacent to power outlets to thereby retain power cords and plugs in electrical engagement with the power outlets. The retention components can be secured to the structure using any suitable mechanism, such as by using fasteners, snap fit, and so forth. The retention components can be configured to retain power cords and plugs within outlets mounted to a wall, in a power bars having any desired configuration, or other structures. The retention components have a housing defining an interior sized to receive a plug of the power cord therein. The housing includes an opening in an outwardly facing surface to receive the power cord therethrough so that the housing can be secured to the structure.

In a first embodiment, a wall plate is provided herein having a retention portion configured to retain a plug end of an electrical cord, such that with the wall plate secured to a wall or other substrate, the plug end of the electrical cord is retained between the wall and the wall plate, thereby preventing one from walking away from the wall with the entire electrical cord. The retention portion includes an interior sized to receive the plug end therein and a through-opening to allow a middle, wire portion of the electrical cord and second end to pass therethrough to be connected to an electrical device. The through-opening is sized with at least one dimension smaller than a corresponding dimension of the plug end so that the plug end is restricted from passing therethrough.

While the depicted form of the retention feature is designed and configured to accommodate standard two or three prong electrical plug charging connectors for smart phones, tablets, PCs and other mobile or immobile devices, the retention feature could be easily modified to accommodate smaller USB power outlet connectors. That is, most charging cords for mobile devices include a first end with a first connector for connecting to a charging or power source such as a wall power outlet, and a second end with a second connector for plugging into a device to be charged. However, due to the proliferation of mobile devices and the need for electrically charging these devices, recent trends in electrical supply include providing wall power outlets (i.e., electrical sockets) with a USB connector port in addition to or as a substitute for one of the traditional 2-prong or 3-prong electrical outlets. This advantageously enables users to plug the first end of the charging cord directly into the USB outlet without requiring a power adapter. Thus, it should be appreciated that the present invention can be easily modified to accommodate this simple variation.

Figure 1:
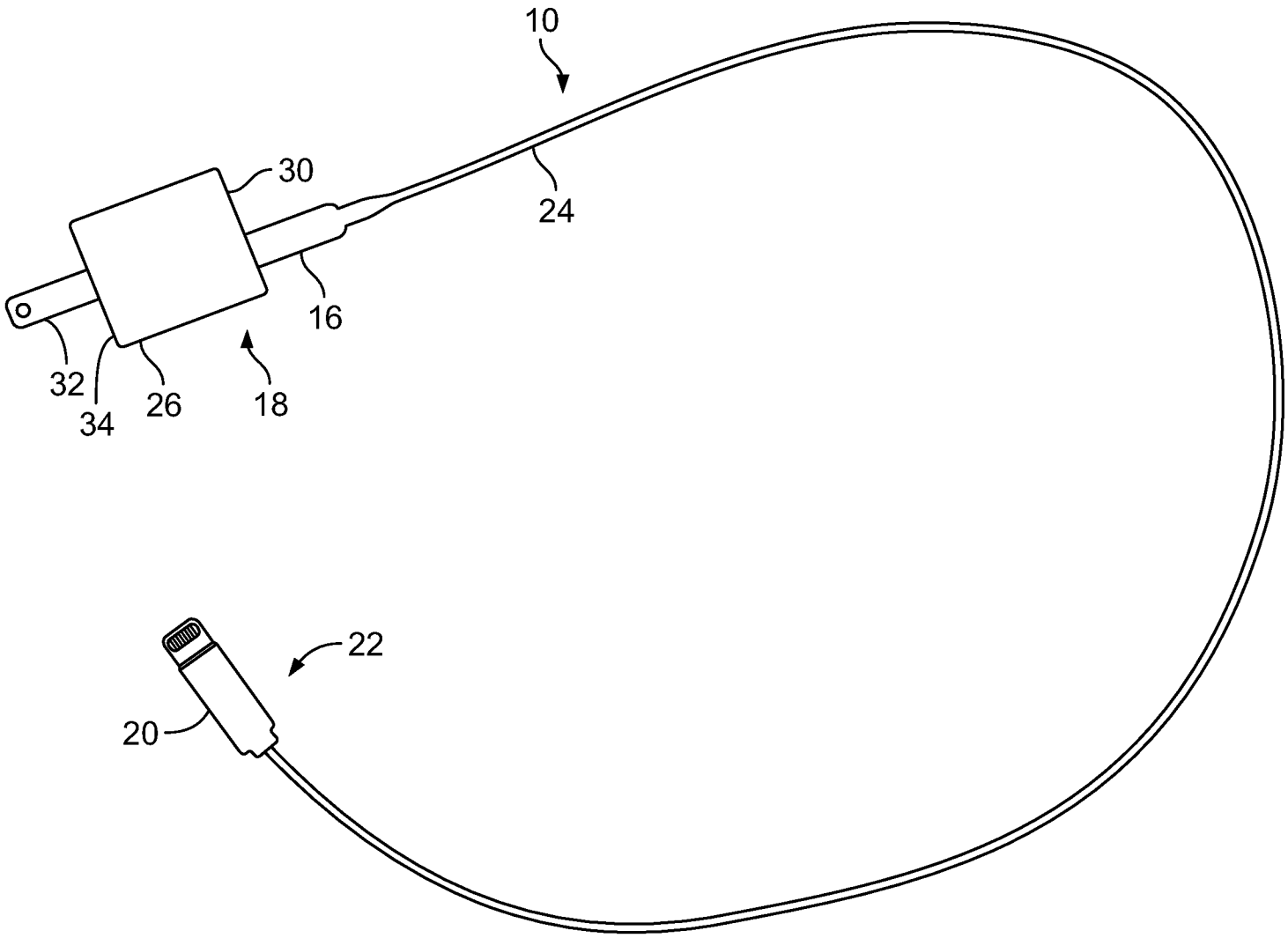
FIG. 1 is a top plan view of an electrical cord and adapter plug in accordance with various embodiments of the present disclosure.
Figure 3:
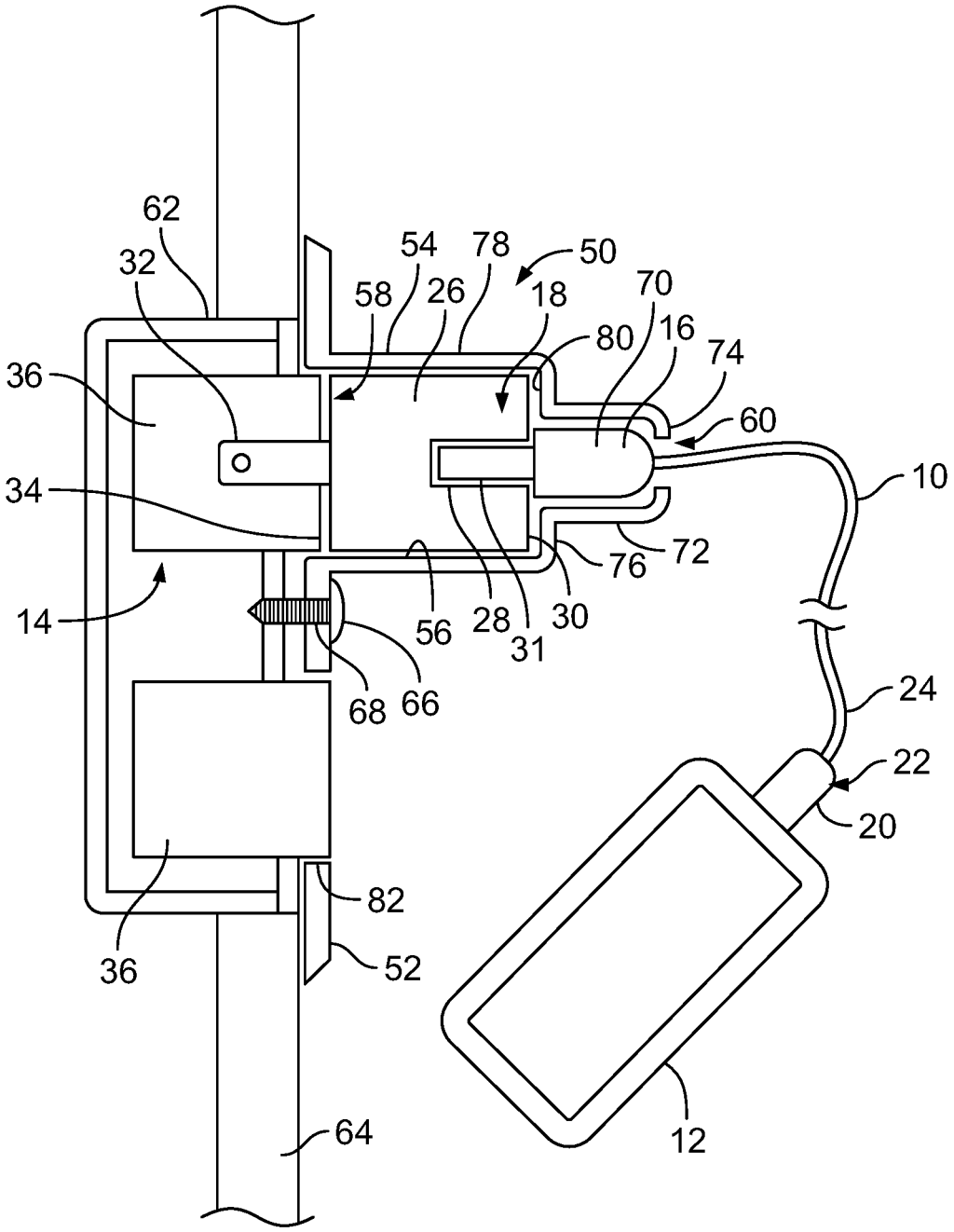
FIG. 3 is a cross-sectional, side view of retention apparatus of FIG. 2 retaining an adapter plug and a first connector of an electrical cord in electrical connection with a wall outlet in accordance with various embodiments of the present disclosure.

Referring now to the figures, an example electrical cord 10 for connecting an electrical device 12 to a power source or secondary electrical device 14 is shown in FIGS. 1 and 3. The electrical cord 10 includes a first connector or plug 16 at a first end 18 thereof, a second connector or plug 20 at a second, opposite end 22 thereof, and a cord or wire portion 24 extending therebetween. With many configurations, the first connector 16 has larger dimensions than the second connector 20, and both the first and second connectors 16, 18 have larger dimensions than the wire portion 24. For example, the second connector 20 can be a Lightning or mini-USB connector, while the first connector 16 can be a USB connector. Of course other connectors and plugs for the first and second connectors 16, 20 can also be utilized.

Referring to FIG. 3, some versions of the electrical cord 10 can utilize an adapter 26 at the first end 18 thereof. In these instances, the first end 18 of the electrical cord 10 can include the adapter 26, the first connector 16, or a combination of both the adapter 26 and the first connector 16. The adapter 26 includes a port 28 on a first side 30 thereof configured to couple to a plug portion 31 of the first connector 16 and a plug 32 on a second side 34 thereof. For example, the power source 14 can include an electrical wall socket 36 and the plug 32 can have a corresponding configuration such as a 2-prong or 3-prong configuration. Of course, the plug 32 can have any desired configuration corresponding to the power supply or secondary electrical device 14. And, as mentioned above, some versions do not require the adapter 26 at all such that the plug portion 31 of the first connector 16 plugs directly into a complementary charging socket.

An exemplary embodiment of a wall plate or outlet cover 50 will now be described with reference to FIGS. 2 and 3. The wall plate 50 includes a base portion 52, which can have a generally planar configuration and, optionally, a beveled or tapered edge 53 as shown, and a retention portion 54 extending outwardly from the base portion 52. The retention portion 54 has an interior 56 sized to receive the first end 18 of the electrical cord 10 therein. The retention portion 54 further includes a back opening 58 to the interior thereof configured to align with and extend around the socket 36 so that the first end 18, such as the first connector 16, the adapter 26, or both, can be electrically coupled thereto and a front opening 60 sized so that the second connector 20 and wire portion 24 can pass therethrough. Moreover, the front opening 60 can be sized to have at least one dimension smaller than a corresponding dimension of the first end 18, and the first connector 16 and/or the adapter 26 thereof, so that the first end 18 cannot pass therethrough. For example, the front opening 60 can have a smaller width than the first connector 16, a smaller height than the first connector 16, or both, or a smaller width than the adapter 26, a smaller height than the adapter 26, or both.

The wall plate 50 is configured to be secured adjacent to the socket 36, such as to structure of the socket 36, a junction box 62, a wall 64 extending around the socket 36, and so forth, by any suitable mechanism. For example, the wall plate 50 can be secured using one or more fasteners 66, having any desired drive type, such as square, hex, slotted, Phillips, Torx, spline, and the like, extending through an opening 68 on the base portion 52.

In some embodiments, the retention portion 54 can be configured for particular first end 18 shapes and sizes. By one approach, a depth of the retention portion interior 56, corresponding to a distance from the power source 14 to the front opening 60, can be sized to be equal to or slightly larger, e.g., about 1 to 10 mm, about 1 to 5 mm, about 2 to about 3 mm, etc., than a depth of the first end 18 corresponding to a depth projecting from the socket 34. As such, with the first end 18 received within the interior 56 of the retention portion 54, movement of the first end 18 is restricted and the connection with the power source 14 can be maintained.

By another approach, a cross-section of the retention portion 54, taken along a plane generally orthogonal to the depth thereof, can be have dimensions slightly larger than a particular cross-section of the first end 18. In the illustrated form, the first end 18 has a generally box-shaped configuration with a rectangular cross-section and rounded edges. Accordingly, if desired, the interior 56 of the retention portion 54 can have a rectangular, or rectangular with rounded edges, cross-section that is slightly larger than the first end 18. As such, the retention portion 54 can restrict the first end 18 from lateral, vertical, and rotational movement during use.

Further, as discussed above, the first end 18 of the electrical cord 10 can include the adapter 26 and the first connector 16. With such a configuration, a body portion 70 of the first connector 16 often extends a distance away from the adapter 26. If desired, the retention portion 54 can include an extension portion 72 that is sized to receive the body portion 70, or part of the body portion 70, therein during use. In some forms, first connectors 16 can have a generally box-shaped configuration with a generally uniform width and height. As such, the extension portion 72 can include a narrowing portion 74, narrowing the width, height, or both, a distal end thereof so that the front opening 60 is sized to have at least one of a smaller height or width, or both, than the first connector 16 to retain the first connector 16 therein. By another approach, the extension portion 72 can have a tapered configuration to sequentially reduce the width and/or height thereof.

In such a configuration, the retention portion 54 can optionally include a shoulder portion 76 extending between a rear portion 78 thereof sized to receive the adapter 26 and the dimensionally smaller extension portion 72. As such, the interior 56 of the retention portion 54 includes a stop surface 80 on an interior of the shoulder portion 76 that is configured to abut first side 30 of the adapter 26 during use, preventing the adapter 26 from becoming unconnected from the power source 14.

If desired, the wall plate 50 can include one or more retention portions 54. For example, with a two socket 36 configuration as shown in FIG. 2, the wall plate 50 can include two retention portions 54. If desired, however, the wall plate 50 can include one or more traditional socket openings 84 so that other sockets 36 of the power source 14 can be used in a traditional manner.

Figure 4:
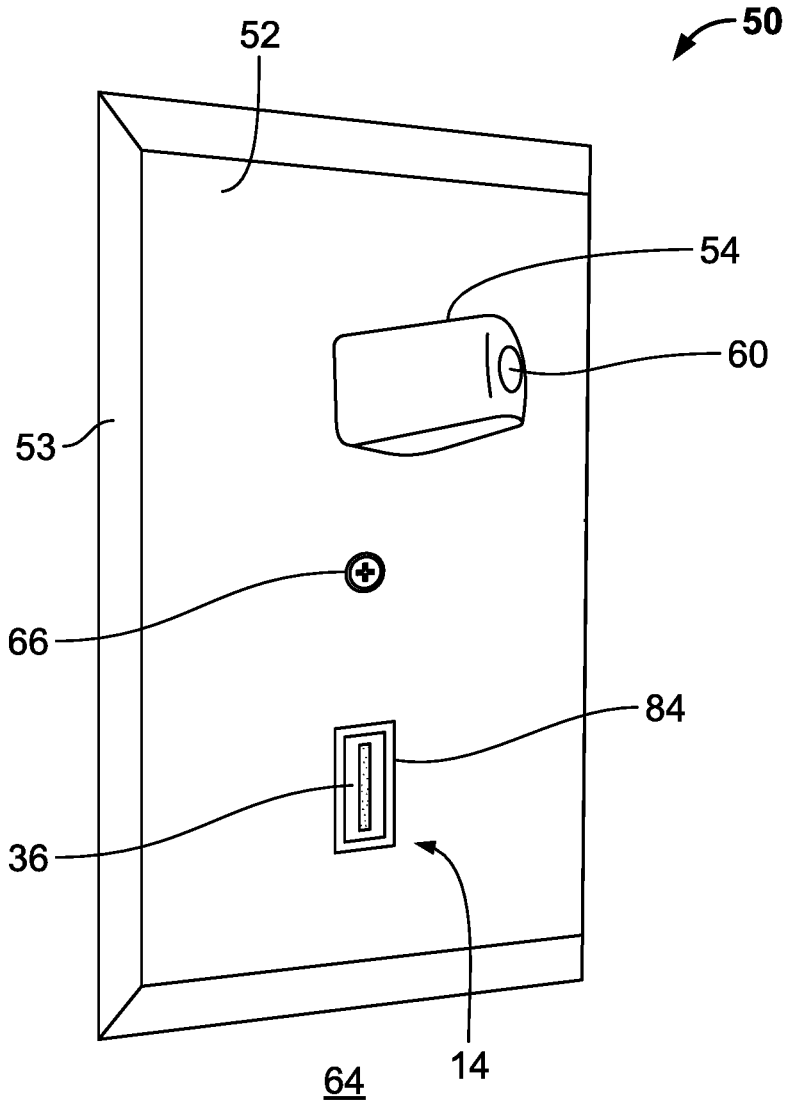
FIG. 4 is a perspective view of a second embodiment of a retention apparatus including a wall plate in accordance with various embodiments of the present disclosure.

By way of example, as shown in FIG. 4, in a configuration without the adapter 26, the first end 18 would only include the first connector 16. As such, in a second embodiment, the retention portion 54 would be configured similarly to the extension portion 72 extending away from the base portion 52 so that the first connector 16 is retained therein during use. Further, rather than a traditional 2-prong or 3-prong electrical socket 36, the socket 36 of this form is can be a USB port with a corresponding generally rectangular socket opening 84.

The wall plate 50 can have a unitary, single piece construction, such as by injection or blow molding, or can be multiple components secured together using any suitable mechanism.

So configured, if a user would like to prevent the first end 18 of the cord 10 from coming disconnected from the power source 14, the user can thread the second end 22 through the back and front openings 58, 60 of the extension portion interior 56 and pull the second end 22 or wire 24 so that the first end 18 is pulled toward the back opening 58. The user can then plug the first end 18 into the socket 34 or other power source 14 and orient the wall plate 50 so that the first end 18 is received within the retention portion interior 56 and any traditional socket openings 84 are aligned with the other sockets 34. Finally, the user can secure the wall plate 50 using the one or more fasteners 66. If desired, the user can pull on the second end 22 or wire until the first end 18 is received within the extension portion interior 56 and plug the first end 18 into the socket 34 or other power source 14 while securing the wall plate 50. Thereafter, the wall plate 50 prevents the first end 18 from becoming unconnected to the power source 14 until the wall plate 50 is unsecured and the wire 24 and second end 22 are pulled back through the retention portion 54.

Figure 5:
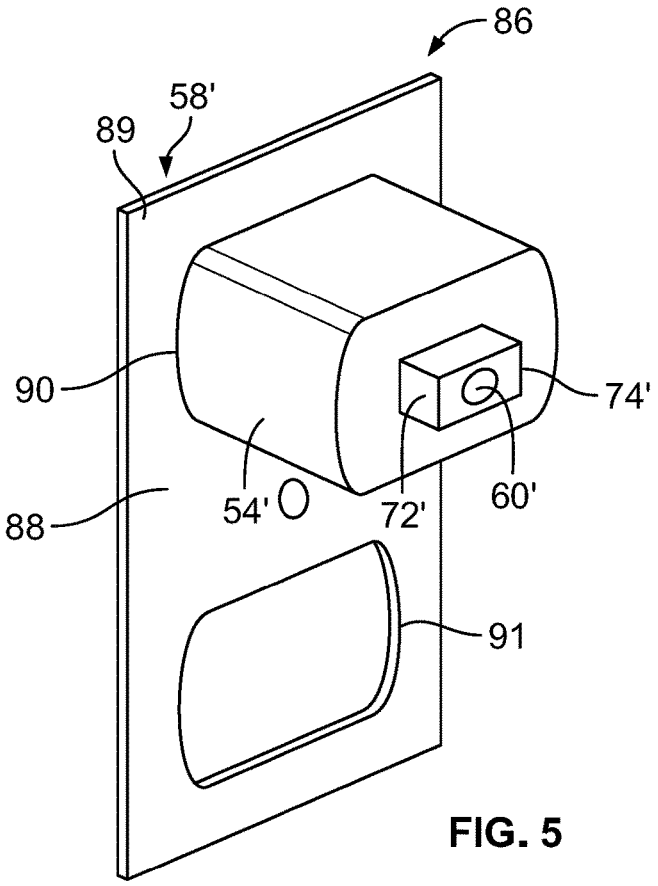
FIG. 5 is a perspective view of a third embodiment of a retention apparatus including a retention member in accordance with various embodiments of the present disclosure.
Figure 6:
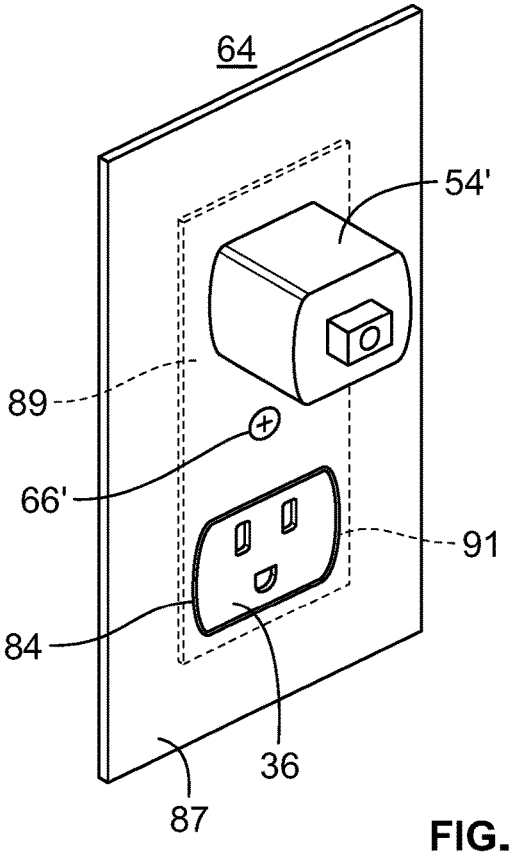
FIG. 6 is a perspective view of the retention member of FIG. 5 installed with a wall plate adjacent to an electrical outlet in accordance with various embodiments of the present disclosure.

A third embodiment of a retention apparatus is shown in FIGS. 5 and 6. In this form, a retention member 86 is configured to retrofit a conventional wall plate 87 to provide the advantages set forth above with respect to the embodiment of FIGS. 2-4. Accordingly, only the differences with respect to the above embodiment will be described herein, with similar structures and components designated with a prime.

As shown, the retention member 86 includes a body 88 having a retention portion 54' and a flange portion 89 that projects outwardly from a rear edge 90 of the retention portion 54'. The flange portion 89 can have any desired footprint, such as rectangular, circular, oval, and so forth. In the illustrated form, the flange portion 89 has a rectangular footprint that extends away from the retention portion 54' to include a socket opening 91 extending therethrough. The socket opening 91 is configured to align with an adjacent power source or socket 36. Advantageously, disposing the flange portion 89 around two, or more, of the sockets 36 stabilizes the retention member 86 during use and distributes forces acted on the retention member 86, such as a result of the cord 10 being inadvertently pulled or someone accidentally hitting the retention member 86. So configured, movement of the retention member 86, and that movement's impact on the wall plate 87, is minimized.

Figure 2:
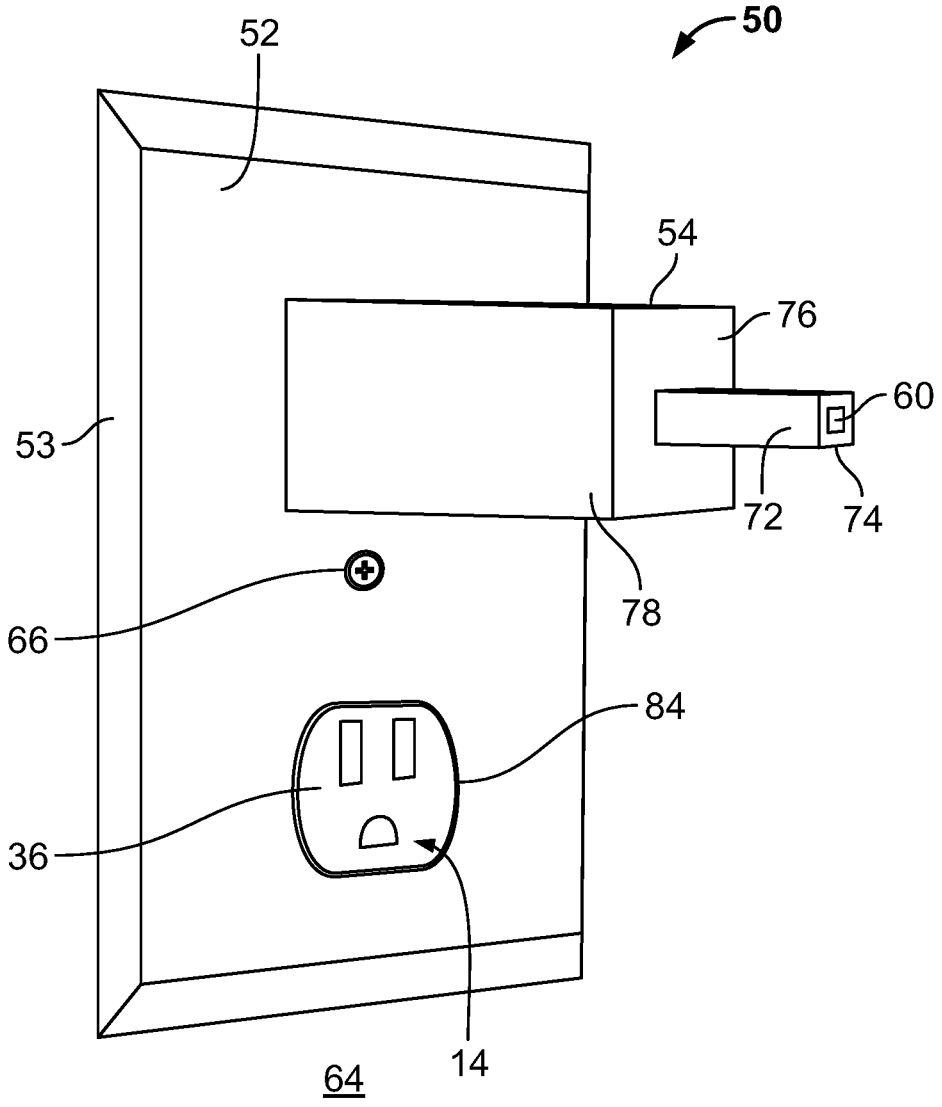
FIG. 2 is a perspective view of a first embodiment of a retention apparatus including a wall plate in accordance with various embodiments of the present disclosure.

As opposed to the above embodiment shown in FIGS. 2 and 3, the retention member 86 of this form is configured to be disposed rearwardly of the conventional wall plate 87 so that the flange portion 89 is captured between the wall plate 87 and the wall socket 36, junction box 62, and/or wall 64 (shown in FIG. 3) and the retention portion 54' projects through the socket opening 84. When the wall plate 87 is secured to the socket 36, junction box 62, and/or wall 64, the retention member 86 is secured in an installed position and cannot be removed without removing the wall plate 87. If desired, a user can install a retention member 86 for any or all outlets 36.

The retention portion 54' has an interior 56' sized to receive the first end 18 of the electrical cord 10 therein. The rear edge 90 of the retention portion 54 defines a back opening 58' to the interior 56' thereof configured to align with and extend around the socket 36 so that the first end 18, such as the first connector 16, the adapter 26, or both, can be electrically coupled thereto and a front opening 60' sized so that the second connector 20 and wire portion 24 can pass therethrough. Moreover, the front opening 60' can be sized to have at least one dimension smaller than a corresponding dimension of the first end 18, and the first connector 16 and/or the adapter 26 thereof, so that the first end 18 cannot pass therethrough. For example, the front opening 60' can have a smaller width than the first connector 16, a smaller height than the first connector 16, or both, or a smaller width than the adapter 26, a smaller height than the adapter 26, or both. If desired, the retention portion 54' can include an extension portion 72' that is sized to receive the body portion 70, or part of the body portion 70, of the first connector 16 therein during use. In some forms, first connectors 16 can have a generally box-shaped configuration with a generally uniform width and height. As such, the extension portion 72' can include a narrowing portion 74', narrowing the width, height, or both, a distal end thereof so that the front opening 60' is sized to have at least one of a smaller height or width, or both, than the first connector 16 to retain the first connector 16 therein. By another approach, the extension portion 72' can have a tapered configuration to sequentially reduce the width and/or height thereof.

With this configuration, a user can thread the second end 22 through the back and front openings 58', 60' of the extension portion interior 56' and pull the second end 22 or wire 24 so that the first end 18 is pulled toward the back opening 58'. The user can then plug the first end 18 into the socket 34. The user then disposes the retention portion 54' over the first end 18 and secures the wall plate 87.

Figure 7:
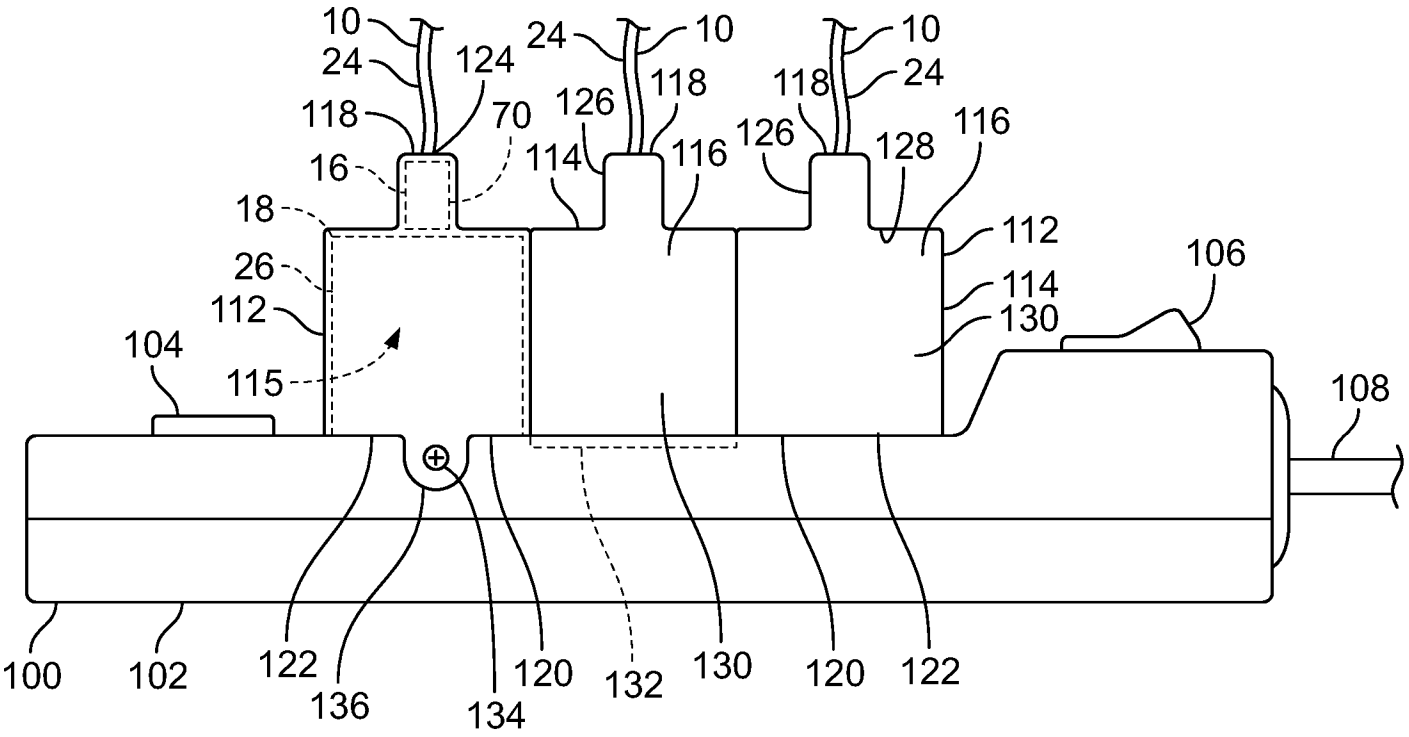
FIG. 7 is a side elevation view of a power bar having a plurality of electrical outlets showing fourth embodiments of retention members for retaining plugs in electrical connection with the power bar coupled thereto in accordance with various embodiments of the present disclosure.
Figure 8:
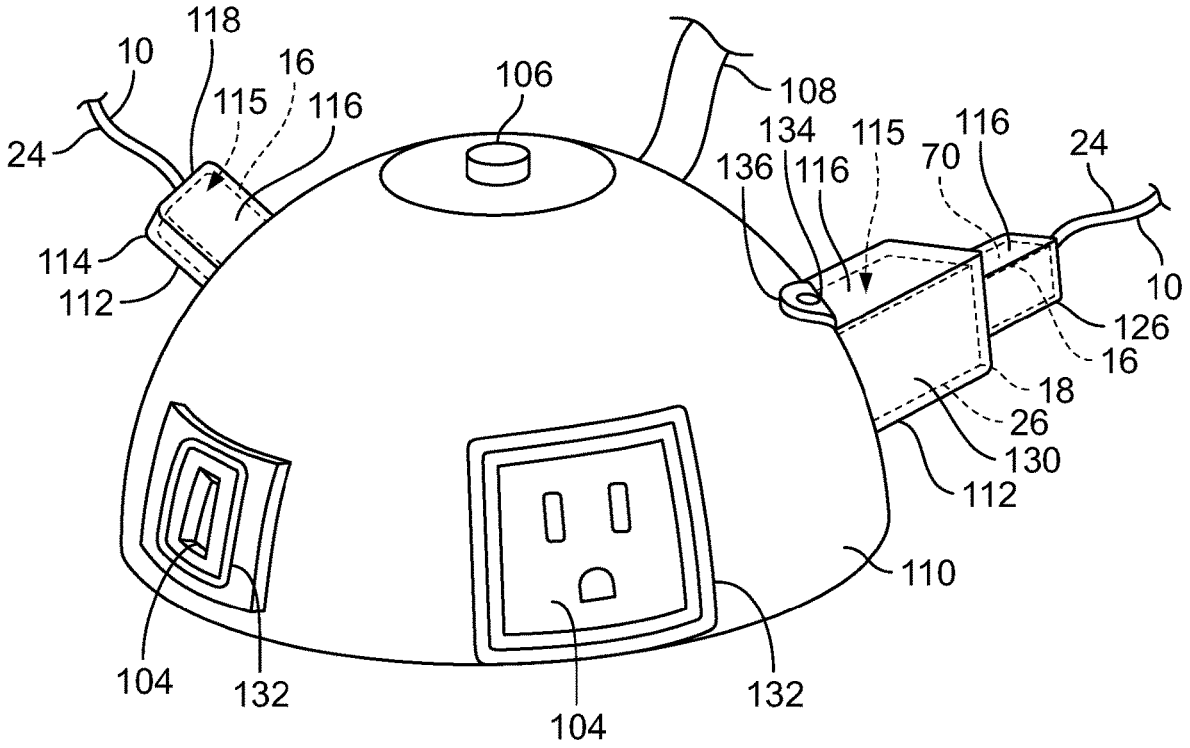
FIG. 8 is a perspective view of a power outlet structure having a plurality of electrical outlets distributed thereabout showing fifth embodiments of retention members for retaining plugs in electrical connection with the power outlet structure coupled thereto in accordance with various embodiments of the present disclosure.
Figure 9:
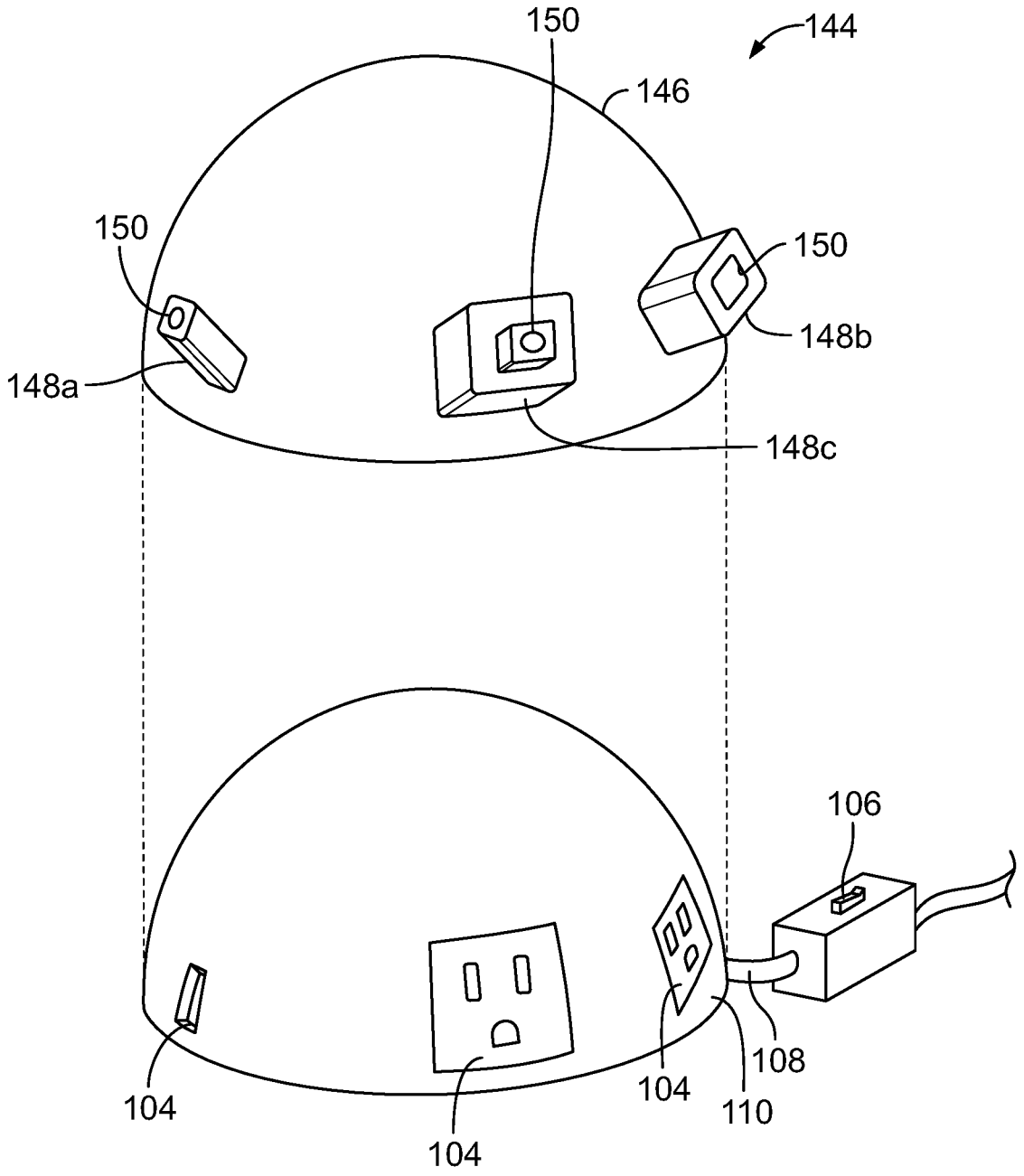
FIG. 9 is a perspective view of a power outlet structure having a plurality of electrical outlets distributed thereabout showing a sixth embodiment of a retention cover member for retaining plugs in electrical connection with the power outlet structure coupled thereto in accordance with various embodiments of the present disclosure.

Additional retention embodiments are shown in FIGS. 7-9. Rather than a wall socket 36, the embodiments of these forms are configured to couple to portable housings of electrical outlets. In one example, a power bar 100 is shown in FIG. 7 that includes a housing 102, a plurality of electrical outlets 104 spaced along a length thereof, a switch device 106 configured to control power supply to the electrical outlets 104, and a power cord 108 configured to be connected to a power source, such as a wall outlet. As discussed above, electrical cords 10 having wires 24 with plugs 16, 26 at the first end 18 thereof are configured to be inserted into the outlets 104 of the power bar 100 to thereby receive electricity therethrough.

Another outlet housing form is shown in FIGS. 8 and 9. In these forms, the electrical outlets 104 are provided on a hemispherical housing 110. The outlets 104 are spaced generally equidistantly radially around the housing 110. The outlets 104 as described herein can take the form described previously configured to receive plugs having two or three prongs. Alternatively, as shown in FIG. 8, any of the outlets 104 can be configured to receive USB connectors 16, or other known connectors, to avoid the use of adapters. Further, although bar shaped and semi-hemispherical housings 102, 110 are shown, the disclosures herein are applicable to any power cord, outlet, and housing combination.

In order to retain the plugs 16, 26 in a plugged configuration, in the embodiments of FIGS. 8 and 9, one or more retention members 112 are configured to couple to the housing 102, 110. As shown, each retention member 112 has a configuration similar to the retention portion 54 described above and includes a body 114 having an interior 115 sized to receive one of the first connectors 16, the adapters 26, or both therein. Further, the body 114 has a depth sized so that the first end 18 can be received therein at a depth to be plugged into the outlet 102 and the body 114 can be coupled to the housing 102, 110 as described in more detail below.

The body 114 of this form has a generally rectangular cross-section with four side wall panels 116 and an end wall 118, as shown in the embodiment of FIG. 2 and in side view in FIG. 7. In order to receive the first end 18 therein, the body 114 includes a rear, plug opening 120 defined by an edge 122 of the sidewall 116 at one end and a front, wire opening 124 in the end wall 118 at an opposite end. The wire opening 124 is preferably sized so that at least one dimension is smaller than the first end 18 so that the first end 18 cannot be pulled through the wire opening 124. So configured, a user can thread the wire 24 through the wire opening 124 until the first end 18 is adjacent to the body 114. Thereafter, the user can either insert the first end 18 into the outlet 104 and subsequently secure the retention member 112 to the housing 102, 110. By a further approach, the user can pull the first end 18 into the body 114 and insert the first end 18 into the outlet 104 by securing the retention member 112 to the housing 102, 110.

As with the above embodiment, for cord 10 and outlet 104 combinations that require an adapter 26, the retention member 112 can include an extension portion 126 that is sized to receive the body portion 70, or part of the body portion 70, of the first connector 16 therein during use. The extension portion 126, and the end wall 118 thereof, can narrow the width, height, or both of the wire opening 124 so that the wire opening 124 is sized to have at least one of a smaller height or width, or both, than the first connector 16 to retain the first connector 16 therein. By another approach, the extension portion 126 can have a tapered configuration to sequentially reduce the width and/or height thereof.

In such a configuration, the body 114 can optionally include a shoulder portion 128 extending between a rear portion 130 thereof sized to receive the adapter 26 and the dimensionally smaller extension portion 126, so that the body 114 has a stepped configuration. Of course other configurations can be utilized for other connectors and/or adapters.

The retention members 112 can couple or secure to the housings 102, 110 by any suitable method. In a first approach, the housing 102, 110 can include a channel or recess 132 that extends adjacent to the outlet 104 that is sized to receive a portion of the retention member body 114 in a friction or snap fit to thereby secure the retention member 112 to the housing 102, 110. The channel 132 can extend entirely around the outlet 104 as shown or can extend along portions thereof with corresponding tabs on the retention member 112.

In a second approach, the retention members 112 can be secured to the housings 102, 110 using fasteners 134 that extend through the retention member 112 and into the housing 102, 110. If desired, the retention member 112 can include a tab portion 136 that projects along the housing 102, 110. Advantageously, with this configuration, the retention members 112 can be secured to housings 102, 110 that are not otherwise configured for having the retention members 112 secured thereto. In a further approach, the retention member 112 can be permanently attached to the housings 102, 110, such as by a permanent adhesive, ultrasonic welding, or the like.

Although the retention members 112 have been described as individual bodies 114 for each outlet 104, multiple retention members 112 can be provided in a single piece construction. For example, for the power bar 100, a number of retention members 112 can be provided in a row corresponding to some or all of the number of outlets 104. Additionally, although FIG. 6 shows walls extending between adjacent bodies 114, a combined embodiment could instead have only outer walls with individual wire openings 124 and, optionally, extension portions 126.

By another approach, as shown in FIG. 9, a retention member 144 can be configured to couple or secure to and over the housing 110. The retention member 144 includes a body 146 having a shape corresponding to a shape of the housing 110 and retention portions 148 that align with the outlets 104 of the housing 110. The retention member 144 can be configured to couple to the power source housing 110 by any suitable method or mechanism. For example. The member 114 can snap fit to the housing 110, can be secured using fasteners, can be welded thereto, and so forth. The outlets 104 can be 2-prong, 3-prong, USB connections, or other suitable electrical connections. Similarly, the retention portions 148 can take any of the forms described herein.

The retention portions 148 are sized to receive the first end 18, including the first connector 16 and/or the adapter 26, of the electrical cord 10 therein. The retention portions 148 each include back openings (not shown) that align with the outlet 104 so that the first end 18 can be electrically coupled thereto and a front opening 150 sized so that the second connector 20 and wire portion 24 can pass therethrough. As with the above embodiments, the front openings 150 are sized to have at least one dimension smaller than a corresponding dimension of the first end 18, and the first connector 16 and/or the adapter 26 thereof, so that the first end 18 cannot pass therethrough.

Three example configurations for the retention portions 148 are illustrated, but it will be understood that a given retention member 144 can include any desired combination according to desired uses and/or housing outlet 104 configurations. For example, the retention portion 148*a* can be configured to retain the first connector 16, the retention portion 148*b* can be configured to retain the adapter 26, and the retention portion 148*c* can be configured to retain both the first connector 16 and the adapter 26.

Figure 10:
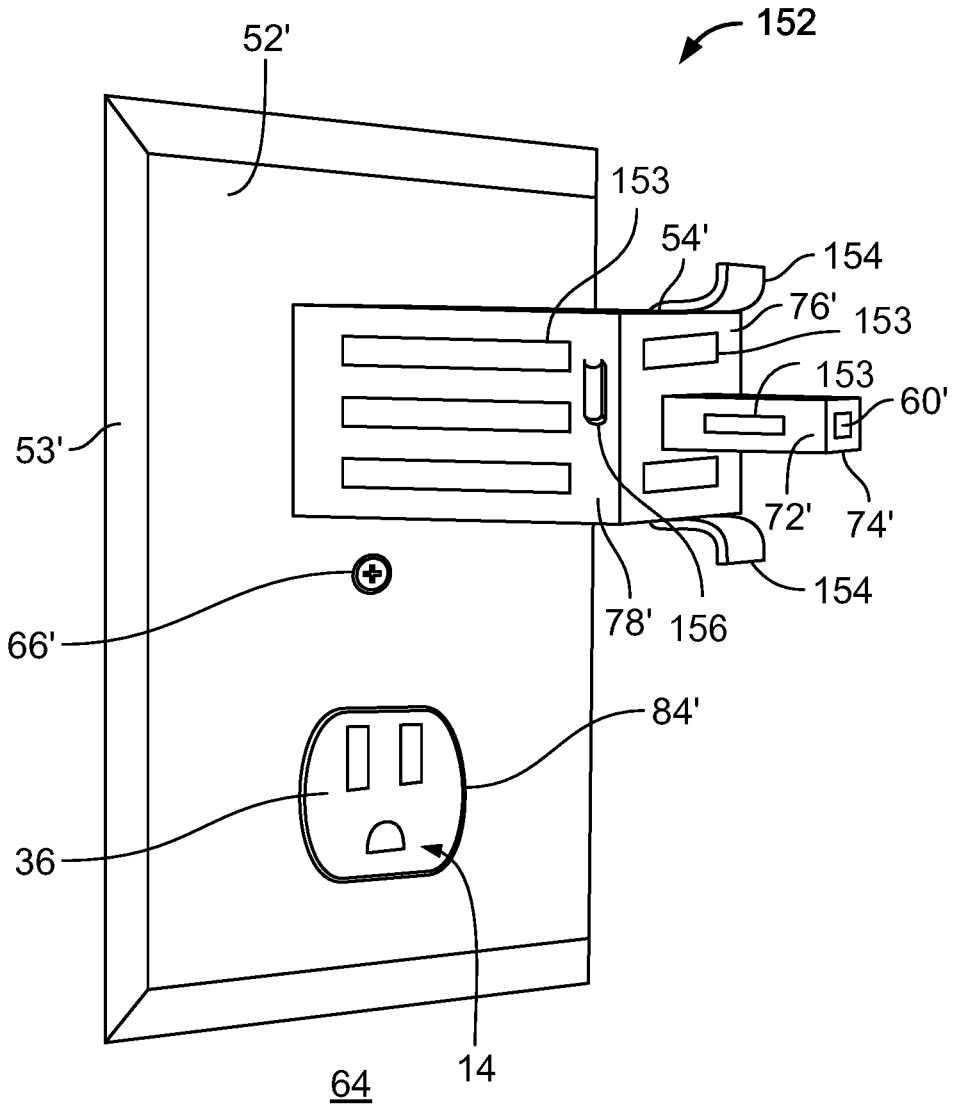
FIG. 10 is a perspective view of a seventh embodiment of a retention apparatus including a wall plate in accordance with various embodiments of the present disclosure Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

In another embodiment, as shown in FIG. 10, a retention device 152 can be configured to ventilate heat generated by the first end 18 of the cord 10, including the first connector 16, the adapter 26, or both. In the illustrated example, the retention device 152 is configured similarly to the above embodiment shown in FIG. 2 and, as such, similar features have the same reference characters designated with a prime.

The retention device 152 this form includes one or more ventilation openings 153 that extend through any desired wall of the retention portion 54'. For example, the ventilation openings 153 can be disposed through the rear portion 78', the extension portion 72', and/or the shoulder portion 76'. Moreover, the ventilation openings 153 can take any desired form, such as elongate slots as shown, cylindrical, curvilinear, or other suitable shapes. Further, similarly configured ventilation openings may optionally be incorporated into any of the above embodiments.

If desired, as shown in FIG. 10, the retention device 152 can include structure that is configured to retain the wire portion 24 of the cord 10 when the wire portion 24 is wrapped around the retention portion 54' in a storage configuration. For example, when a user is not charging the electrical device 12, the wire portion 24 and second end 22 of the cord 10 extend out of the retention device 152 and may become a nuisance. In the illustrated form, the retention device 152 can include arms or rabbit ears 154 or similar structure that projects outwardly and/or away from the retention portion 54'. So configured, a user can wrap the wire portion 24 around the retention portion 54' and the arms 154 are configured to retain the wire portion 24 in the wrapped configuration.

More specifically, distal ends of the arms 154 can project generally along a plane parallel with the base portion 52' or wall 64 so that the coiled wire portion 24 is restricted from moving away from the base portion 52' or wall 64. The arms 154 can be curved as shown, angled, or can project outwardly away in a generally perpendicular direction from the retention portion 54', as desired. As is understood, the cord 10 can include a friction retention coupling member that couples the wire portion 24 to hold the wire portion 24 in a coiled configuration. By another approach, the retention portion 54' or arms 154 can include a similarly configured coupling member 156. So configured, the wire portion 24 is held in a coiled configuration, while the arms 154, in combination with the base portion 52' and/or wall 64, restrict movement laterally along the retention portion 54'.

By a further approach, the arms 154 can be pivotably mounted to the retention portion 54' so that the arms 154 can be pivoted between a storage position extending generally along the retention portion 54' and a use position extending away therefrom. For example, the retention portion 54' can include recesses (not shown) sized to receive some or all of the arms 154 therein. Further, similarly configured arms may optionally be incorporated into any of the above embodiments.

While the retention portion 54 and retention member 112 has been described and shown as being formed or molded with an interior cavity that substantially conforms to the exterior geometry of the first end 18, including the connector 16, the adapter 26, or both, in some versions, the device can further include one or more spacer elements that allow a user to utilize the wall plate 50 with other charging cords that do not precisely fit into the cavity of the retention portion/member 54, 112. Such spacers may be pre-molded to accommodate other known charging cord configurations, and can be easily placed inside the retention portion/member 54, 112 prior to threading the charging cord therethrough. This would advantageously provide an increased level of flexibility and utility.

It should be appreciated that the foregoing wall plate and other retention members disclosed herein are preferably constructed of one piece, by injection molding, casting, machining, 3D printing, or any other practical and available means known to those skilled in the art.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

What is claimed is:

1. A retention system for securing to a portable power supply housing having one or more electrical outlets to thereby retain a first end of an electrical cord in a plugged configuration with one of the electrical outlets, the retention system comprising:

a body having retention portion including a sidewall at least partially defining an interior sized to receive the first end of the electrical cord therein, an edge of the sidewall defining a plug opening at a first end of the body and the body having a wire opening extending therethrough at a second, opposite end thereof; and a mounting portion of the sidewall configured to couple to the portable power supply housing with the edge of the sidewall engaging the portable power supply housing to thereby secure the retention portion thereto, wherein the mounting portion comprises an opening extending along a portion of the body sized to receive a fastener to thereby secure the body to the portable power supply housing and the mounting portion includes a tab portion projecting outwardly from the first end thereof, the tab portion including the opening extending therethrough and, along with the edge of the sidewall, configured to extend along an exterior surface of the portable power supply housing when the retention portion is coupled to the portable power supply housing;

wherein the plug opening is sized to receive the first end of the electrical cord therethrough and the wire opening has at least one dimension that is smaller than a corresponding dimension of the first end, such that the first end cannot pass therethrough.

2. The retention system of claim 1, wherein the body has a stepped configuration with a main portion configured to receive an adapter therein and an extension portion configured to receive a first connector of the electrical cord therein.

3. The retention system of claim 2, wherein the body includes a shoulder extending between the main portion and the extension portion, the shoulder configured to retain the adapter in a connected configuration with the electrical outlet.

4. The retention system of claim 2, wherein a cross-section of the main portion has dimensions slightly larger than corresponding dimensions of the adapter.

5. The retention system of claim 2, wherein a cross-section of the extension portion has dimensions slightly larger than corresponding dimensions of the first connector.

6. The retention system of claim 1, wherein the body includes a base portion having a shape corresponding to a shape of the portable power supply housing, such that the base portion is configured to be disposed over the housing to thereby secure the body to the portable power supply housing.

7. The retention system of claim 6, wherein the portable power supply housing includes a plurality of electrical outlets; and the body comprises a plurality of retention portions, each of the plurality of retention portions configured to align with one of the plurality of electrical outlets with the body secured to the portable power supply housing.

8. The retention system of claim 6, wherein the shape of the base portion comprises an elongate bar configuration.

9. The retention system of claim 1, wherein the interior of the retention portion has a depth equal to or slightly larger than a depth of the first end of the electrical cord with the first end coupled to the electrical outlet.

10. The retention system of claim 1, wherein the portable power supply housing includes a plurality of electrical outlets; and the sidewall of the retention portion at least partially define an interior sized to receive the first end of a plurality of electrical cords therein, the body sized to extend over at least two of the plurality of electrical outlets of the portable power supply housing.

11. The retention system of claim 1, further comprising the electrical cord, wherein the first end of the electrical cord includes a first connector configured to electrically couple the electrical cord to the power supply, an adapter, or both.

12. The retention system of claim 11, wherein the first end includes only the adapter.

13. The retention system of claim 11, wherein the adapter comprises a 2-prong or 3-prong electrical connector and the first connector comprises a USB connector.

14. The retention system of claim 11, wherein the first end includes only the first connector, the first connector comprising a USB connector.

15. The retention system of claim 11, wherein the body is permanently attached to the portable power source housing.

16. The retention system of claim 1 in combination with the portable power source housing, the portable power source housing comprising an on/off switch and an electrical cord including a plug.

17. An apparatus comprising:

a portable power supply housing having one or more electrical outlets and comprising an on/off switch and an electrical cord including a plug;

a retention system configured to retain a first end of an electrical cord in a plugged configuration with one of the electrical outlets, the retention system comprising:

a body having a retention portion including a sidewall at least partially defining an interior sized to receive the first end of the electrical cord therein, an edge of the sidewall defining a plug opening at a first end of the body and the body having a wire opening extending therethrough at a second, opposite end thereof, wherein the plug opening is sized to receive the first end of the electrical cord therethrough and the wire opening has at least one dimension that is smaller than a corresponding dimension of the first end, such that the first end cannot pass therethrough; and a mounting portion of the sidewall configured to couple to the portable power supply housing with the edge of the sidewall engaging the portable power supply housing to thereby secure the retention portion thereto;

wherein the mounting portion comprises the edge of the sidewall at the first end thereof; and the portable power source housing includes a channel extending around at least one of the plurality of electrical outlets, the channel configured to receive the entire edge of the sidewall therein to thereby secure the body to the portable power source housing.

* * * * *